US005939684A

United States Patent [19]

Sin

[11] Patent Number: 5,939,684

[45] Date of Patent: Aug. 17, 1999

[54] SWITCH ASSEMBLY HAVING JOG SHUTTLE FUNCTION AND CONTACT FUNCTION

[75] Inventor: Young-Dae Sin, Suwon, Rep. of Korea

[73] Assignee: Samsung Electronics Co. Ltd., Suwon, Rep. of Korea

[21] Appl. No.: 08/891,045

[22] Filed: Jul. 10, 1997

[30] Foreign Application Priority Data

Jul. 15, 1996 [KR] Rep. of Korea ..... 96-20936

[51] Int. Cl.[6] ..... H01H 25/04

[52] U.S. Cl. ..... 200/18; 200/4; 200/6 A

[58] Field of Search ..... 200/564–572, 200/336, 329, 330, 341, 4, 6 R, 6 A, 6 C, 11 R, 14, 11 D, 11 J, 11 K, 5 R, 16 R, 16 A, 16 C, 16 D

[56] References Cited

U.S. PATENT DOCUMENTS

| | | | |
|---|---|---|---|
| 4,394,546 | 7/1983 | Harumatsu | 200/5 R |
| 4,857,677 | 8/1989 | Tanaka et al. | 200/5 R |
| 5,430,262 | 7/1995 | Matsui et al. | 200/6 A |
| 5,543,592 | 8/1996 | Gaultier et al. | 200/6 A |
| 5,550,343 | 8/1996 | Borger et al. | 200/569 |
| 5,621,196 | 4/1997 | Nishijima et al. | 200/6 A |

*Primary Examiner*—Michael A. Friedhofer
*Attorney, Agent, or Firm*—Staas & Halsey

[57] ABSTRACT

A switch assembly having a jog shuttle function and a contact function. The switch assembly includes a jog shuttle switch installed on a printed circuit board, a plurality of contact switches disposed on four symmetric positions centering around the jog shuttle switch, and a printed circuit board holder installed on the printed circuit board to thereby compensate for a height difference between the upper side of the printed circuit board and the upper end of the contact switch. The switch assembly also includes a shuttle holder having poles connected with the printed circuit board centering around the jog shuttle switch, a shuttle knob connected to the shuttle holder having marking parts formed on its upper side, and a jog knob connected to the shuttle knob.

31 Claims, 11 Drawing Sheets

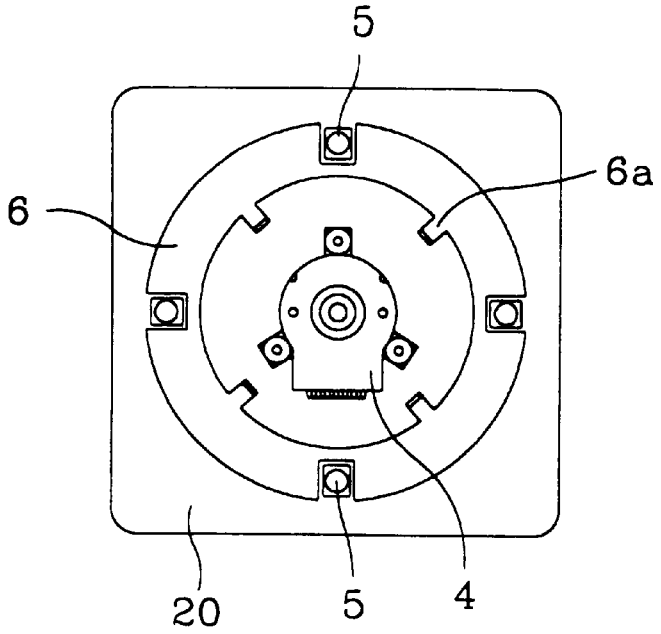
Fig. 6A
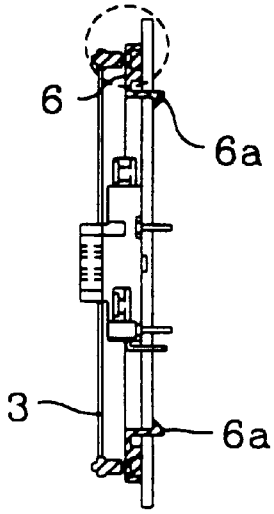
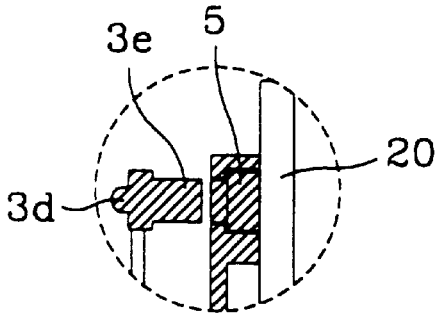
Fig. 6C
Fig. 6B

SWITCH ASSEMBLY HAVING JOG SHUTTLE FUNCTION AND CONTACT FUNCTION

BACKGROUND OF THE INVENTION

1. Field of the Invention

This invention relates to a switch assembly having a jog shuttle switch function as well as a contact switch function and, more particularly, to a switch assembly which integrates a jog shuttle knob and a contact knob. The present application is based on Korean Application No. 20936/1996, which is incorporated herein by reference.

2. Description of the Related Art

Generally, as illustrated in FIGS. 1, 2A and 2B, jog shuttle knobs 41 and 42 each having a jog shuttle function and a contact knob 43 having a usual function are installed on the front panels of electronic products.

As shown in FIGS. 1 and 2B, the jog shuttle knob is divided into a jog knob 42 and a shuttle knob 41. The jog knob 42 and the shuttle knob 41, which are put together, are connected to a jog shuttle switch 44 installed on a printed circuit board 45.

As shown in FIG. 2A, the jog knob 42 can be infinitely rotated, while the shuttle knob 41 only can be rotated 60 degrees from side to side. That is, the operated jog knob 42 is not restored to the original state but keeps the current state, while the shuttle knob 41 is restored to the original state after operating. This restoration is due to the restoring power of a torsion spring (not shown) installed in the shuttle knob 41.

The functions of the usual shuttle knob 41 and jog knob 42 can be easily appreciated by a person having ordinary skill in the relevant field.

As illustrated in FIG. 3, a contact switch 46, installed on a printed circuit board 47, is positioned on the lower part of the contact knob 43. In operation, when a predetermined force is applied on the upper end of the contact knob 43 in an arrow "A" direction, the contact switch 46 comes in contact with the lower end of the contact knob 43 so that it begins controlling operations, i.e., regenerating, pausing, stopping, etc.

As illustrated in FIGS. 4A and 4B, a volume control knob 51 is connected to a volume control switch 52 installed on a printed circuit board 54. After operating, the volume control knob 51 is restored into the original state by means of a torsion spring 53.

Therefore, when the user applies a predetermined force on the volume control knob 51 to control the volume, the volume control switch 52 operates together with the rotation of the volume control knob 51. Thereafter, if the force applied is removed, the volume control knob 51 is restored to the original state.

As described above, the dual structure, in which the contact knob 43 and the jog shuttle knobs 41 and 42 are separately operated, has a problem that when the knobs are all installed on a front panel 100 as shown in FIG. 1, they occupy so large a space as to create an obstacle in designing and planning electronic products in which these knobs are employed.

Also, since a volume control knob is separated from a contact knob, the volume control knob and contact knob occupy so large a space as to create an obstacle in designing and planning the electronic products.

SUMMARY OF THE INVENTION

Accordingly, an object of the present invention is to provide a switch assembly in which a jog shuttle switch having a jog shuttle function and contact switches each having a usual function are integrated into one body so that the obstacle caused by complex functions in designing and planning electronic products can be removed.

Another object of the present invention is to provide a switch assembly in which a volume control switch and contact switches are integrated into one body so that the obstacle caused by complex functions in designing and planning the electronic products can be removed.

To achieve the above objects, a switch assembly according to the present invention includes a jog shuttle switch centrally installed on a printed circuit board, a plurality of contact switches connected to the jog shuttle switch in four symmetric directions, a printed circuit board holder installed on the printed circuit board to compensate for a height difference between the upper side of the printed circuit board and the upper ends of the contact switches, a shuttle holder installed on the printed circuit board holder, a shuttle knob connected to the shuttle holder and having marking parts formed on its upper side, and a jog knob connected to the shuttle knob.

BRIEF DESCRIPTION OF THE DRAWINGS

The accompanying drawings, which are included to provide a further understanding of the invention and are incorporated in and constitute a part of this specification, illustrate particular embodiments of the invention and, together with the description, serve to explain the principles of the invention. In the drawings:

FIG. 6A is an exterior view of the inventive switch assembly;

FIG. 6B is a cross-sectional view of the inventive switch assembly;

FIG. 6C is a blow up cross-sectional view of the dotted circle portion of FIG. 6B;

DETAILED DESCRIPTION OF THE PREFERRED EMBODIMENT(S)

Figure 1:
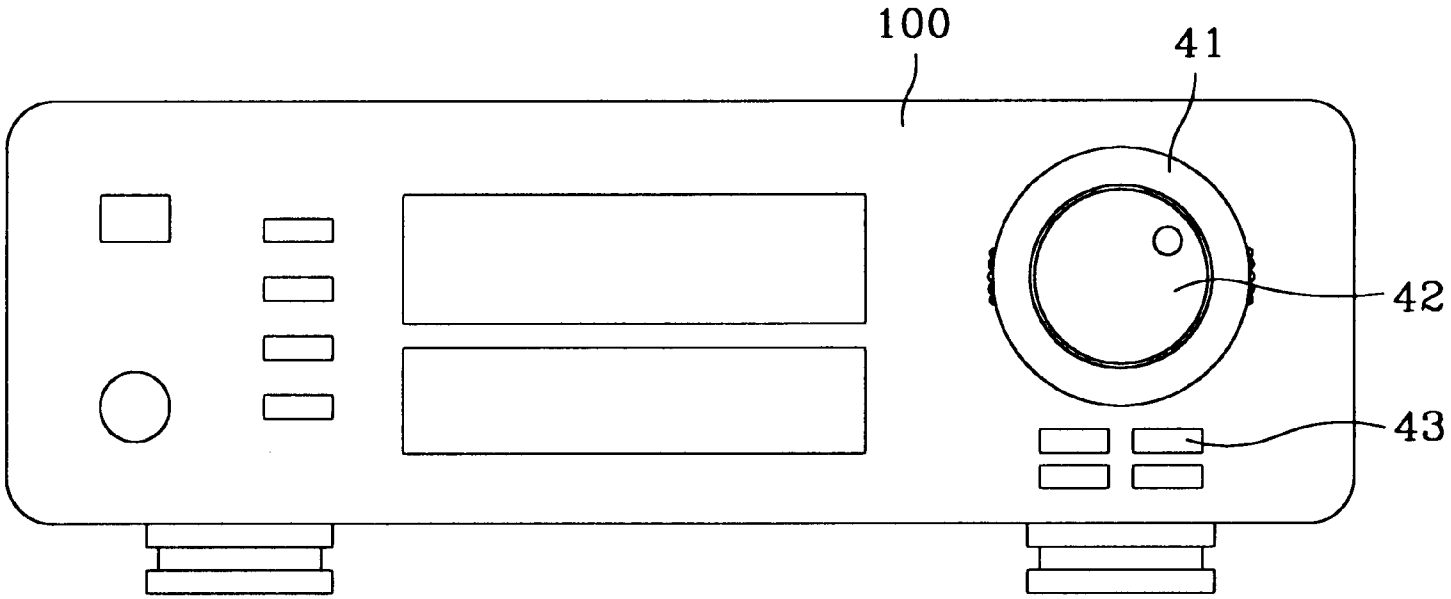
Fig. 1 PRIOR ART
FIG. 1 is a front view of a conventional switch assembly in which a jog shuttle knob and a usual knob are installed on the front panel of an electronic product.
Figure 2A:
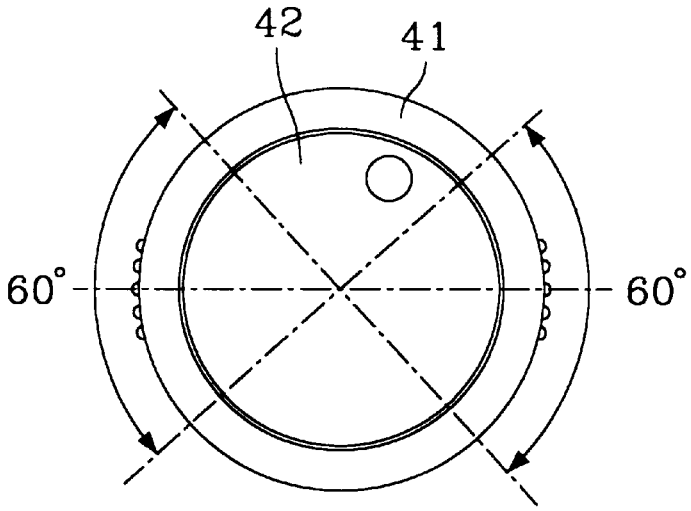
Fig. 2A PRIOR ART
FIG. 2A is a front view showing an operational structure of the conventional jog shuttle knob shown in FIG. 1.
Figure 2B:
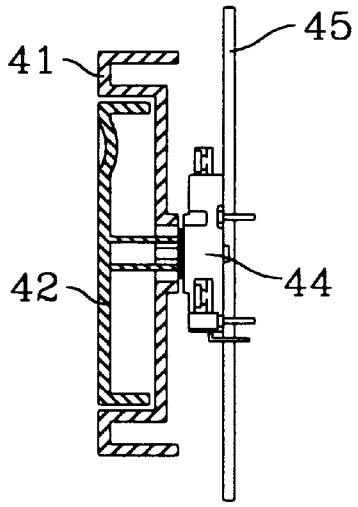
Fig. 2B PRIOR ART
FIG. 2B is a cross-sectional view showing an operational structure of the conventional jog shuttle knob shown in FIG. 1.
Figure 3:
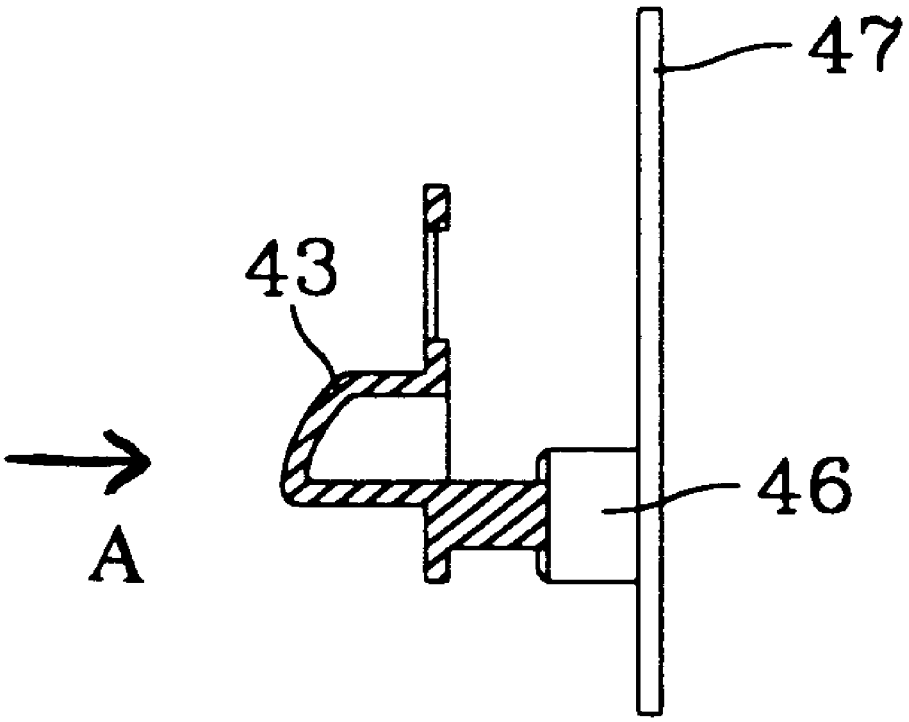
Fig. 3 PRIOR ART
FIG. 3 is a side elevation showing an operational state of the conventional usual knob shown in FIG. 1.
Figure 4A:
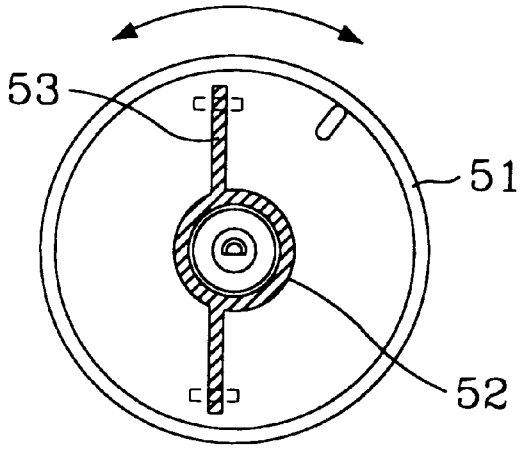
Fig. 4A PRIOR ART
FIG. 4A is a plan view of a conventional volume control knob.
Figure 4B:
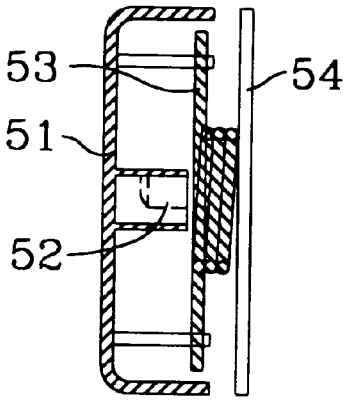
Fig. 4B PRIOR ART
FIG. 4B is a cross-sectional view of the conventional volume control knob shown in FIG. 1.

Reference will now be made in detail to the preferred embodiments of the present invention, examples of which are illustrated in the accompanying drawings. Throughout the drawings and the specification, similar reference numerals denote similar elements. Furthermore, redundant descriptions of features common between the conventional system and preferred embodiments of the present invention are omitted.

Figure 5:
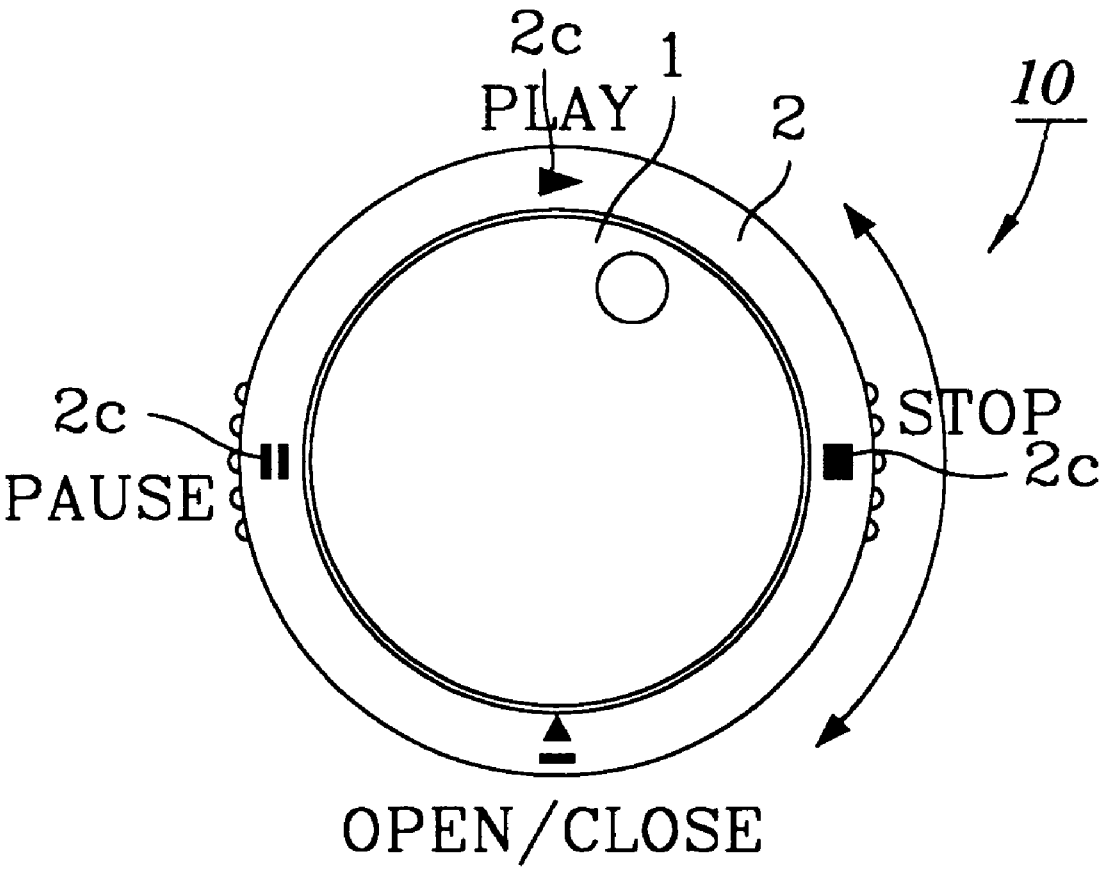
FIG. 5 is a front view of a switch assembly having a jog shuttle function and a contact function according to a preferred embodiment of the present invention.

As illustrated in FIG. 5, the inventive switch assembly 10 includes a jog knob 1 and a shuttle knob 2 having marking parts 2*c* for designating usual operations. The marking parts 2*c* are silk-printed and formed on four symmetric positions of the shuttle knob.

Also, as illustrated in FIGS. 6A through 6C, the inventive switch assembly 10 having a jog shuttle function and a contact function includes a plurality of contact switches 5 which are disposed on the four symmetric positions centering around a jog shuttle switch 4.

Since the contact switches 5 are installed on a printed circuit board 20, a height difference is present between the upper side of the printed circuit board 20 and the upper ends of the contact switches 5. Thus, a printed circuit board holder 6 is installed on the printed circuit board 20 to compensate for the height difference. Stop projections 6*a* are formed on the predetermined positions of the printed circuit board holder 6 to fix the printed circuit board holder 6 on the four symmetric positions of the printed circuit board 20. Thus, the printed circuit board holder 6 is fixed on the printed circuit board 20 by inserting the stop projections 6*a* into through-holes of the printed circuit board 20.

Figure 7:
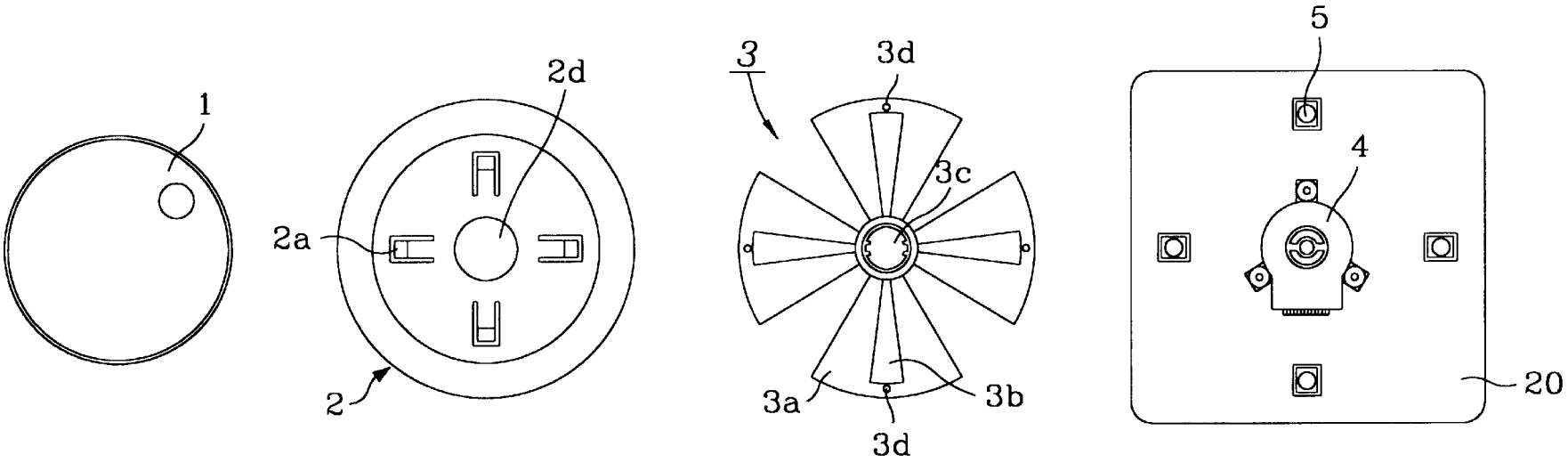
FIG. 7 is a cross-sectional view showing the combination process of the inventive switch assembly components.
Figure 8:
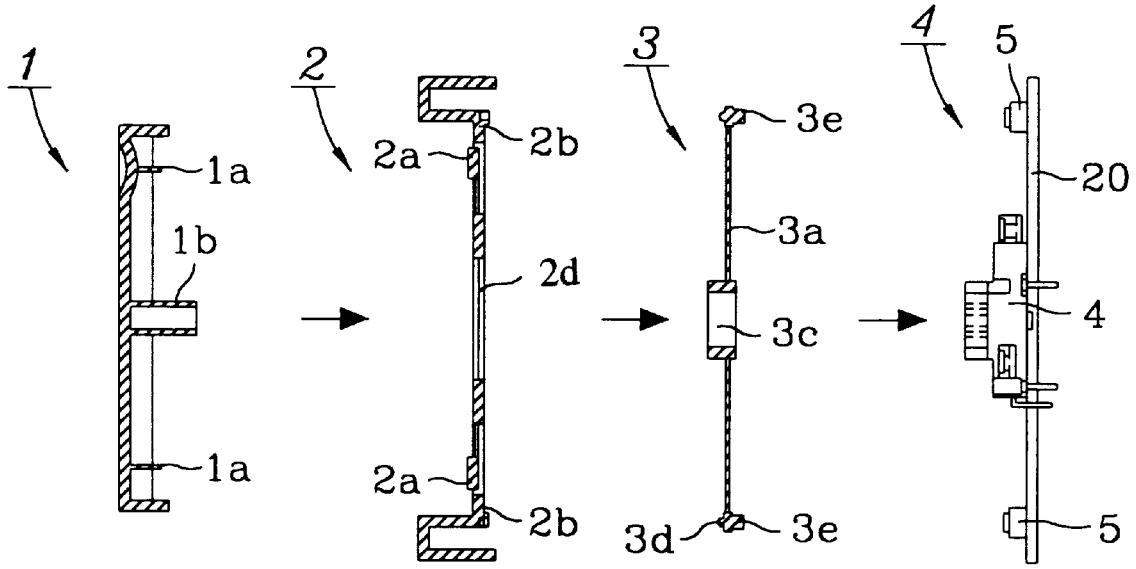
FIG. 8 is a cross-sectional view showing the combination process of the inventive switch assembly.

As illustrated in FIGS. 7 and 8, a shuttle holder 3 having poles 3*e* formed on the predetermined positions centering around the jog shuttle switch 4, the shuttle knob 2 integrated with the shuttle holder 3 into one body, and the jog knob 1 connected to the shuttle knob 2 are installed on the printed circuit board 20.

Also, as illustrated in FIG. 7, the shuttle holder 3 extends omnidirectionally to form symmetric wing parts 3*a*, each having a through-hole 3*b* and a projection 3*d*. The through-holes 3*b* each form a vent hole in the respective wing parts 3*a*, thereby providing effective flexibility of the wing parts 3*a*. FIG. 6C shows a blow up cross-sectional view of one of the projections 3*d*, one of the poles 3*e* and one of the contact switches 5, along with the printed circuit board 20.

As illustrated in FIG. 8, the projections 3*d* are respectively formed on the ends of the wing parts 3*a* to combine the shuttle holder 3 with the shuttle knob 2. Also, grooves 2*b* are adequately formed on the predetermined positions of the shuttle knob 2 to receive the projections 3*d*. Therefore, the shuttle holder 3 and the shuttle knob 2 are integrated into one body by inserting the projections 3*d* into the grooves 2*b*.

Moreover, poles (protrusions) 3*e* are formed on the contrary positions to the projections 3*d* so that when the user applies a predetermined force on the shuttle knob 2, the upper end of the pole 3*e* contacts the upper end of the contact switch 5 or the former is separated from the latter to thereby realize the on/off function of the contact switch 5 (see FIG. 6B).

Also, as illustrated in FIGS. 7 and 8, ribs 1*a* are formed on the rear surface of the jog knob 1 and tension ribs 2*a* are formed on the shuttle knob 2 to prevent the fluctuation of the jog knob 1 as well as the shuttle knob 2. The tension ribs 2*a* have an extended symmetric form. A cylindrical coupler 1*b* is formed in the center of the jog knob 1 and is inserted through a shuttle knob hole 2*d* and a shuttle holder hole 3*c* to assemble the jog knob 1, the shuttle knob 2 and the shuttle holder 3 with the jog shuttle switch 4.

Figure 9:
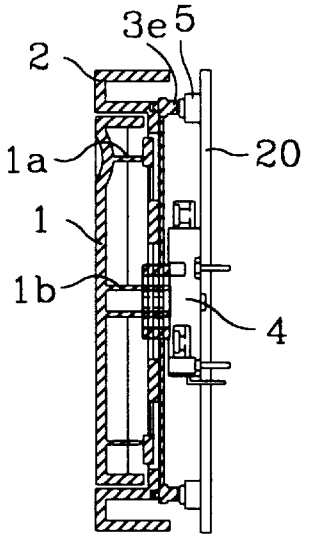
FIG. 9 is a cross-sectional view showing the operational state of a shuttle knob of the inventive switch assembly.
Figure 10:
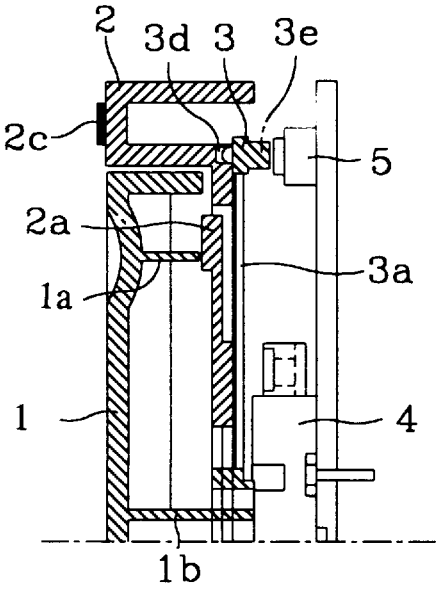
FIG. 10 is a cross-sectional view showing the operational state of a jog knob of the inventive switch assembly.

As illustrated in FIGS. 9 and 10, when the jog knob 1 is connected to the shuttle knob 2, the end of the rib 1*a* closely contacts the end of the tension rib 2*a*. When the shuttle holder 3 is in a standard position, namely, when the shuttle knob is not rotated in either direction, a gap "g" is present between the pole 3*e* of the shuttle holder 3 and the upper end of the contact switch 5, as shown in FIG. 12A.

As illustrated in FIG. 10, marking parts 2*c* are formed on the upper sides of the shuttle knob 2 to designate usual operations. Since the shuttle knob 2 is integrated with the shuttle holder 3 into one body, when the user applies a predetermined force on the marking part 2*c*, the corresponding pole 3*e* pushes the corresponding contact switch 5 so that the usual operation begins working.

Figure 12A:
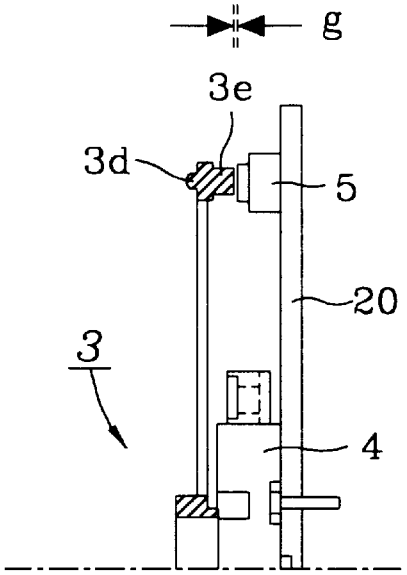
FIG. 12A is a front view showing the installation state of a printed circuit board holder of the inventive switch assembly.
Figure 12B:
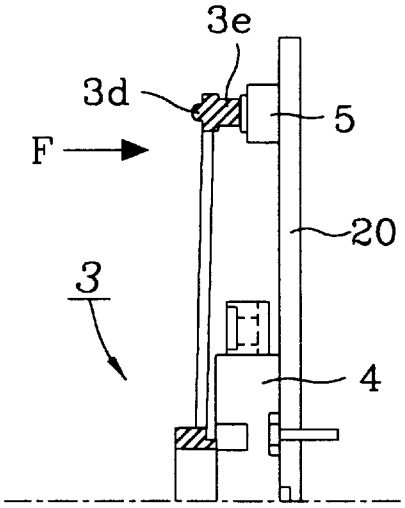
FIG. 12B is a cross-sectional view showing the combination state of the printed circuit board holder of the inventive switch assembly.

As illustrated in FIGS. 12A and 12B, the pole 3*e* can push the contact switch 5 because the gap "g" is present between the upper end of the pole 3*e* and the upper end of the contact switch 5.

Figure 11:
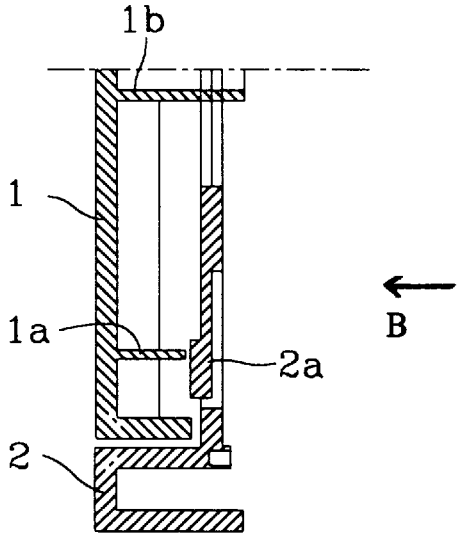
FIG. 11 is a cross-sectional view showing the rotating state of the shuttle knob of the inventive switch assembly.

As illustrated in FIG. 11, the fluctuation of the shuttle knob 2 due to the gap for the movement of the contact switch 5 can be prevented with the tension rib 2*a* formed on the shuttle knob 2. That is, the rib 2*a* of the shuttle knob 2 always supports the rib 1*a* formed on the rear surface of the jog knob 1 owing to the repulsive power of the tension rib 2*a* in an arrow "B" direction.

Figure 13:
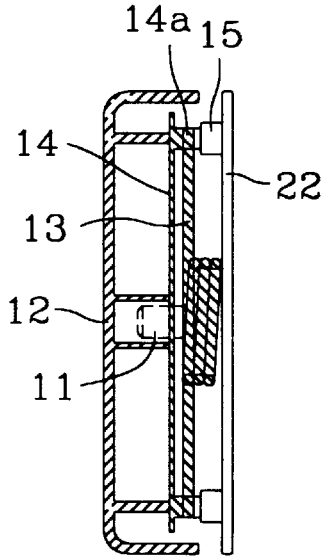
FIG. 13 is a cross-sectional view showing the combination state of a volume control knob according to another preferred embodiment of the present invention.

As illustrated in FIG. 13, the usual volume control switch structure having no jog knob can be equally applied into the inventive switch assembly having a volume control function and a contact function. The inventive switch assembly includes a plurality of contact switches 15 for performing usual functions. They are installed on the radially symmetric positions centering around a volume control switch 11.

Also, a torsion spring 13 is installed on a printed circuit board 22 centering around the volume control switch 11. A shuttle holder 14 having poles 14*a* is installed on the position corresponding to the contact switch 15 to designate the on/off function of the contact switch 15. Then, a volume control knob 12 is disposed on the volume switch 11 installed with the torsion spring 13 and the shuttle holder 14.

To control the volume, the user rotates the volume control knob 12 which is restored into the original state due to the torsion spring 13 after operating. To designate the usual operation, the user pushes down the upper side of the volume control knob 12. Then, the pole 14*a* of the shuttle holder 14 contacts the contact switch 15 so that the switch begins working. As described above, the volume control function and the contact function can be performed by additionally installing the shuttle holder 14 on the volume control knob 12.

As described above, the present invention achieves further various and simple advantages by integrating the jog shuttle switch and the contact switch into one body and removing obstacles in designing and planning electronic products. Also, assembling and disassembling can be easily performed, and a simple operation can be realized.

Therefore, it should be understood that the present invention is not limited to the particular embodiments disclosed herein as the best modes contemplated for carrying out the present invention, but rather that the present invention is not limited to the specific embodiments described in this specification except as defined in the appended claims.

What is claimed:

1. A switch assembly having a jog shuttle function and a contact function, comprising:

a printed circuit board;

a jog shuttle switch having jog and shuttle functions installed on the printed circuit board;

a plurality of contact switches disposed on a plurality of positions centering around the jog shuttle switch;

a printed circuit board holder installed on the printed circuit board to compensate for a height difference between an upper side of the printed circuit board and upper ends of the plurality of contact switches;

a shuttle holder having poles connectable with the plurality of contact switches and centering around the jog shuttle switch;

a shuttle knob connected to the jog shuttle switch to activate the shuttle function of the jog shuttle switch and connected to the shuttle holder so as to be able to activate each of the plurality of contact switches via the poles of the shuttle holder; and a jog knob connected to the jog shuttle switch so as to activate the jog function.

2. The switch assembly as claimed in claim 1, further comprising projections formed on predetermined positions of the printed circuit board holder to fix the printed circuit board holder on the printed circuit board.

3. The switch assembly as claimed in claim 1, wherein the shuttle holder extends omnidirectionally to form symmetric wing parts, the wing parts having through-holes.

4. The switch assembly as claimed in claim 3, further comprising:

projections respectively formed on ends of the wing parts to fix the shuttle holder on the shuttle knob; and grooves formed on predetermined positions of the shuttle knob to receive the projections.

5. The switch assembly as claimed in claim 1, further comprising:

ribs formed on a rear surface of the jog knob; and tension ribs formed on the shuttle knob and which contact corresponding ones of the ribs of the jog knob, to prevent fluctuation of the jog knob and the shuttle knob.

6. The switch assembly as claimed in claim 5, wherein the tension ribs have a symmetric form extended omnidirectionally from a center of the shuttle knob.

7. The switch assembly as claimed in claim 1, wherein the plurality of positions of the plurality of contact switches are four symmetrical positions centering around the jog shuttle switch.

8. The switch assembly as claimed in claim 1, wherein the shuttle knob has marking parts formed on a face opposite to that connected to the shuttle holder, said marking parts indicative of functions to be performed in response to a force being applied to the shuttle knob at a corresponding one of the marking parts.

9. A switch assembly having a volume control function and a contact function of a device, comprising:

a printed circuit board;

a volume control switch with a rotating central projection installed on the printed circuit board, the volume control function being activated in response to rotation of the rotating projector;

a volume control knob connected to the rotating central projection of the volume control switch;

a plurality of contact switches installed on a plurality of positions centering around the rotating central projection;

a torsion spring installed on the printed circuit board centering around the rotating central projection and connected to the volume control knob; and a shuttle holder having poles, the shuttle holder being connected to the volume control knob and installed at positions corresponding to the plurality of contact switches, wherein one of the poles designates an on/off function of a corresponding one of the contact switches in response to a force extended on an edge portion of the volume control knob.

10. The switch assembly as claimed in claim 9, wherein the plurality of positions of the plurality of contact switches are radially symmetrical positions centering around the volume control switch.

11. The switch assembly as claimed in claim 9, wherein the volume control knob has marking parts formed on a face opposite to that connected to the shuttle holder, said marking parts indicative of functions to be performed in response to a force being applied to the volume control knob at a corresponding one of the marking parts.

12. A switch assembly for controlling functions and mounted on a printed circuit board of an electronic device, comprising:

a central rotary switch to control a first one of the functions;

a plurality of second switches to control corresponding second ones of the functions; and a control knob centrally connected to said rotary switch and selectively connectable to said plurality of second switches, wherein said control knob changes a state of said rotary switch in response to being rotated, thereby controlling the first function, and said control knob contacts one of said plurality of second switches in response to a force being applied to a periphery of a surface of said control knob in a direction of the printed circuit board, thereby controlling a corresponding one of the second functions.

13. The switch assembly as claimed in claim 12, wherein said plurality of second switches are formed at a plurality of symmetrical positions centering around said first switch.

14. The switch assembly as claimed in claim 12, wherein:

said rotary switch is a jog shuttle switch which further controls a third one of the functions;

said plurality of second switches are contact switches; and said control knob includes a rotatable shuttle controller which has a limited range of rotation, is biased to a predetermined position, and has protrusions which respectively face the plurality of contact switches when said shuttle controller is in said predetermined position, said shuttle controller changing the state of said jog shuttle switch to control the first function in response to being rotated, and a jog knob connected to a first side of said rotatable shuttle controller opposite to a second side which faces the printed circuit board, and which is continuously rotatable in at least one direction, said jog knob changing the state of said jog shuttle switch to control the third function in response to being rotated;

wherein one of said protrusions contacts a corresponding one of the plurality of contact switches in response to the force being applied to the periphery of the surface of said shuffle controller, to control the corresponding one of the second functions.

15. The switch assembly as claimed in claim 12, wherein:

said rotary switch is a jog shuttle switch which further controls a third one of the functions;

said plurality of second switches are contact switches; and said control knob includes a rotatable shuffle knob which has a limited range of rotation and is biased to a predetermined position, said shuttle knob changes the state of said jog shuttle switch to control the first function, a shuttle holder connected to a first side of said shuttle knob facing the printed circuit board, said shuttle holder having protrusions which respectively face the plurality of contact switches when said shuttle knob is in said predetermined position, and a jog knob connected to a second side of said shuttle knob opposite the first side and which is continuously rotatable in at least one direction, said jog knob changes the state of said jog shuttle switch to control the third function;

wherein one of said protrusions contacts a corresponding one of the plurality of contact switches in response to the force being applied to the periphery of the surface of said shuttle knob, to control the corresponding one of the second functions.

16. The switch assembly as claimed in claim 15, wherein:

said jog knob has ribs facing said shuttle knob; and said shuttle knob has tension ribs contacting corresponding ones of said ribs, to prevent fluctuation of said jog knob and said shuttle knob.

17. The switch assembly as claimed in claim 15, wherein said jog knob, shuttle knob, and shuttle holder are concentric with one another, and a diameter of said jog knob is less than a diameter of said shuttle holder.

18. The switch assembly as claimed in claim 15, wherein said shuttle holder has a cylindrical recess, and said jog knob fits within said cylindrical recess such that said jog knob and shuttle knob extend a same amount from the printed circuit board as one another.

19. The switch assembly as claimed in claim 15, further comprising a printed circuit board holder formed on and extending from the printed circuit board at a height substantially the same as the height that each of said plurality of contact switches extends from the printed circuit board, wherein said circuit board holder at least partially surrounds each of said plurality of contact switches.

20. The switch assembly as claimed in claim 19, wherein:

said shuttle holder has wing parts extending radially from a center of said shuttle holder, wherein each wing part has a projection extending in a direction away from the printed circuit board; and said shuttle knob has grooves which respectively receive said projections extending in the direction away from the printed circuit board, so that said shuttle holder and said shuttle knob rotate in conjunction with each other.

21. The switch assembly as claimed in claim 19, wherein:

said jog knob has ribs facing said shuttle knob; and said shuttle knob has tension ribs contacting corresponding ones of said ribs, to prevent fluctuation of said jog knob and said shuttle knob.

22. The switch assembly as claimed in claim 15, wherein:

said shuttle holder has wing parts extending radially from a center of said shuttle holder, wherein each wing part has a projection extending in a direction away from the printed circuit board; and said shuttle knob has grooves which respectively receive said projections extending in the direction away from the printed circuit board, so that said shuttle holder and said shuttle knob rotate in conjunction with each other.

23. The switch assembly as claimed in claim 22, wherein each of said wing parts has a through-hole.

24. The switch assembly as claimed in claim 22, wherein:

said jog knob has ribs facing said shuttle knob; and said shuttle knob has tension ribs contacting corresponding ones of said ribs, to prevent fluctuation of said jog knob and said shuttle knob.

25. The switch assembly as claimed in claim 12, further comprising a torsion spring to bias said control knob to a predetermined rotational position, wherein said control knob is rotatable within a limited range of rotation.

26. The switch assembly as claimed in claim 12, further comprising:

biasing means;

wherein said plurality of second switches are contact switches, and said control knob has a limited range of rotation, is biased by said biasing means to a predetermined position by said biasing means, and has protrusions which respectively face the plurality of contact switches when said control knob is in said predetermined position, said control knob changing the state of said rotary switch to control the first function in response to being rotated, and one of said protrusions contacts a corresponding one of the plurality of contact switches in response to the force being applied to the periphery of the surface of said control knob, to control the corresponding one of the second functions.

27. The switch assembly as claimed in claim 26, wherein said biasing means is a torsion spring.

28. The switch assembly as claimed in claim 26, wherein said rotary switch is a volume control switch.

29. The switch assembly as claimed in claim 12, further comprising:

biasing means;

wherein said plurality of second switches are contact switches, and said control knob includes a rotatable shuttle knob which has a limited range of rotation and is biased to a predetermined position by said biasing means, said rotatable shuttle knob changes the state of said rotary switch to control the first function, a shuttle holder connected to a first side of said shuttle knob facing the printed circuit board, said shuttle holder having protrusions which respectively face the plurality of contact switches when said shuttle knob is in said predetermined position, and one of said protrusions contacts a corresponding one of the plurality of contact switches in response to the force being applied to the periphery of the surface of said shuttle knob, to control the corresponding one of the second functions.

30. The switch assembly as claimed in claim 29, wherein said biasing means is a torsion spring.

31. The switch assembly as claimed in claim 12, further comprising:

biasing means;

wherein said plurality of second switches are contact switches, and said control knob has a limited range of rotation, is biased by said biasing means to a predetermined position by said biasing means, and has protrusions which respectively face and are spaced apart from the plurality of contact switches when said control knob is in said predetermined position and the force is not applied to the surface of said control knob in the direction of the printed circuit board, said control knob changing the state of said rotary switch to control the first function in response to being rotated, and one of said protrusions contacts a corresponding one of the plurality of contact switches in response to the force being applied to the periphery of the surface of said control knob and said control knob is in said predetermined position, to control the corresponding one of the second functions.

* * * * *